US009811970B2

(12) United States Patent
Shuster

(10) Patent No.: US 9,811,970 B2
(45) Date of Patent: Nov. 7, 2017

(54) METHOD AND APPARATUS FOR TRIGGERING AND DISTRIBUTION OF DIGITAL SCRATCHER TICKETS

(71) Applicant: ACTV8, Inc., Beverly Hills, CA (US)

(72) Inventor: Brian Shuster, Beverly Hills, CA (US)

(73) Assignee: ACTV8, Inc., Beverly Hills, CA (US)

( * ) Notice: Subject to any disclaimer, the term of this patent is extended or adjusted under 35 U.S.C. 154(b) by 98 days.

(21) Appl. No.: 14/918,326

(22) Filed: Oct. 20, 2015

(65) Prior Publication Data

US 2016/0117885 A1 Apr. 28, 2016

Related U.S. Application Data

(60) Provisional application No. 62/067,872, filed on Oct. 23, 2014.

(51) Int. Cl.
*G07F 17/32* (2006.01)
*G07F 17/42* (2006.01)

(52) U.S. Cl.
CPC ..... *G07F 17/3223* (2013.01); *G07F 17/3204* (2013.01); *G07F 17/329* (2013.01); *G07F 17/42* (2013.01)

(58) Field of Classification Search
CPC ..... G07F 17/3204; G07F 17/329
See application file for complete search history.

(56) References Cited

U.S. PATENT DOCUMENTS

| | | | | |
|---|---|---|---|---|
| 6,379,251 | B1 | 4/2002 | Auxier et al. | |
| 9,264,151 | B1 * | 2/2016 | Emigh | G06Q 30/0211 |
| 2006/0287028 | A1 | 12/2006 | MacIver et al. | |
| 2010/0121719 | A1 | 5/2010 | Blair et al. | |
| 2014/0315614 | A1 * | 10/2014 | Granich | G07F 17/3209 463/17 |
| 2014/0370959 | A1 * | 12/2014 | Yacenda | G07F 17/3241 463/18 |

OTHER PUBLICATIONS

International Search Report and Written Opinion, dated Jan. 20, 2016, Application No. PCT/US2015/056736.
International Preliminary Report on Patentability in PCT/US2015/056736 dated May 4, 2017.

* cited by examiner

*Primary Examiner* — Damon Pierce
(74) *Attorney, Agent, or Firm* — Blakely Sokoloff Taylor & Zafman LLP

(57) ABSTRACT

A system for displaying a digital scratcher ticket on a device having an interactive display. A backend data storage and processing unit creates and stores data corresponding to a digital scratcher ticket having a unique identifier. A trigger mechanism storage and processing generates a trigger signal for use by the device. Upon receipt of the trigger signal by the device, the device receives the stored data corresponding to a digital scratcher ticket created by the backend data storage and processing unit. The device then validates the data with the backend data storage and processing unit. The validated data is used to display the digital scratcher on the interactive display, but the displayed digital scratcher ticket is hidden until a user of the device interacts with the interactive display to reveal the digital scratcher ticket.

15 Claims, 6 Drawing Sheets

SCRATCHER

REVEAL SCRATCHER

DISPLAY PROMOTION

METHOD AND APPARATUS FOR TRIGGERING AND DISTRIBUTION OF DIGITAL SCRATCHER TICKETS

FIELD OF THE INVENTION

The invention is directed to interactive entertainment and marketing based on the triggering and distribution of digital scratcher tickets via over the air, radio, streaming broadcast sources, location and proximity detection. Scratcher tickets, also referred to as scratchers, distributed in this manner can be used to increase engagement with consumers via promotional campaigns and direct interaction with consumers using common existing and readily available technologies.

SUMMARY OF THE INVENTION

The invention utilizes existing broadcast sources which are defined as any piece of hardware containing a speaker capable of broadcasting any audio signal that originates from an external location or containing a transmitter for broadcasting radio frequency signals, mainly in the 300 MHz-30 GHz range. Such audio broadcast sources include by way of example only, televisions, computers, tablets, mobile devices, radio, and public address (PA) systems. Such broadcast systems can produce an audio identification (ID) signal which is in the nature of a series of high frequency inaudible tones that when interpreted by a mobile device of an end user can display what are referred to herein as promotional scratcher tickets on the mobile device for use by the end user.

Alternatively, an identification signal can be generated and broadcast using the radio frequency spectrum.

In this regard, a promotional scratcher ticket for a mobile device is the equivalent of what is commonly referred to as a scratcher ticket which is a paper form on which a numbers and/or words are covered by an opaque film which can be removed by scratching the film with the edge of a coin, a fingernail or the like. In the mobile phone context, the numbers, and/or words are "covered" by an opaque screen element which when rubbed by a fingertip or other touch screen sensitive device is removed so as to simulate the scratching of the opaque film on a paper scratcher ticket to reveal the numbers and/or words hidden by the opaque screen element. Stated another way, a mobile scratcher ticket can be described as an interactive digital lottery style scratcher ticket that contains dynamic content. This mobile ticket scratcher allows the user to manually interact with a promotion by scratching the mobile device with their fingertip to uncover portions of the screen hidden by the opaque screen element.

A scratcher ticket according to the invention can also be sent to display which does not have a touch screen. For example, a display connected to a desktop computer need not be a touch display. In this situation, instead of rubbing the screen with a fingertip or other touch screen sensitive device, a mouse, track pad or similar device can be used to provide the necessary interaction with the image being displayed by causing a pointer on the display to move over the image to produce the same effect. That is, the only requirement is that the screen display/user interface must be of the type which allows the user to interact directly with images on the display either by touching the display or by using a device which, in effect, simulates touching the display so that the display is an interactive display.

In an embodiment, a speaker is used to produce an audio ID signal which sends a scratcher via the audio signal and a microphone on the mobile device is used to pick up the audio signal containing the scratcher ticket information. The mobile device converts the received audio signal to produce on the display of the mobile device numbers and/or words encoded with the audio signal which are "covered" by an opaque display element which can be "removed" by swiping or tapping the opaque display element on the display to reveal the numbers and/or words of the scratcher. In this regard, the display on the mobile device is known as a touch screen display or just touch display which allows a user to interact with the device by touching the display with the user's fingertips or pen designed to interact with the touch display.

Since the audio ID is a series of high frequency inaudible tones that when interpreted by a mobile device can display promotional scratcher tickets on the end users device, a speaker that can produce the high frequency signals and microphone that can detect the high frequency signals must be used. In this regard, most if not all currently available mobile devices (phones and tablets) and computers (laptops and desktops) are able to successfully detect the tones as determined by testing and validation across many differing device types and quality standards. As for the speakers needed to broadcast the tones, most currently available mid to high range speakers can produce the necessary high frequency tone. However, few if any subwoofers should be expected to be able to produce the required high frequency tone.

It should be noted that audio ID is one of several possible distribution methods for sending promotional scratcher tickets for use on a mobile device. Other distribution methods include 1) manual interaction though an application running on the mobile device wherein the user taps a button on the screen of the mobile device and receives the scratcher ticket, 2) geofencing which is based on a defined longitude/latitude or other GPS based threshold that triggers upon entry, 3) Bluetooth beacons, 4) RFID, 5), Wi-Fi and other NFC (near field communications) technologies. Distribution methods 2)-5) all use some portion of the radio frequency spectrum. Although distribution method 1) does not use an audio or radio frequency signal, the same concepts described herein for receiving a digital scratcher ticket apply, except that the trigger is generated manually by the user by interacting with an application running on the mobile device. In all cases, the scratcher ticket is sent to the mobile device after the mobile device contacts a server, sending the server location and other application dependent information based on the initiating trigger.

DETAILED DESCRIPTION OF THE INVENTION

Figure 1A:
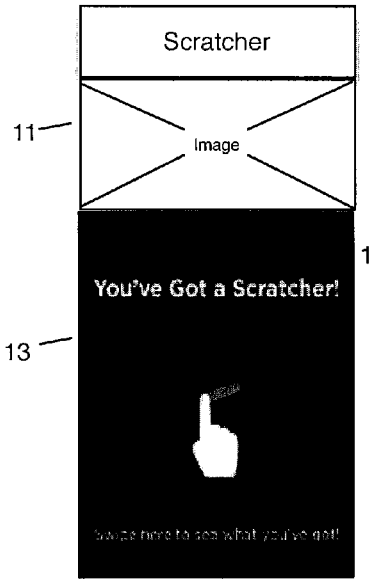
FIG. 1A shows a representation of a mobile device display with a scratcher before the opaque screen element is removed.

The invention relies upon a triggering mechanism to deliver a scratcher to a user's mobile device. Thus, the terms Trigger/RF Trigger mean any action or interaction that initiates the delivery of a scratcher to a user's mobile device. Triggers can be comprised of BTLE, RFID, NFC, high frequency audio, Audio Fingerprinting (AF), Geofencing, Wi-Fi, cell phone and other interactable technologies which can deliver relatively small amounts of information to a mobile device usually based on the location of the device. Additional details regarding these various technologies are set forth below. In this regard, a device could be a mobile device (phone, tablet, smart watch), full computer (desktop/laptop) or any other device with the ability to communicate and pair with BTLE, RFID, NFC, Wi-Fi, Cellular Data signals and GPS signals. A user is any person using an application running on a device capable of receiving and decoding the initiating triggers for scratcher delivery.

BTLE or Bluetooth Low Energy is a technology that uses beacon devices to emit a Bluetooth signal (2450-5800 MHz) that carries unique values that can be associated to specific scratcher ticket instances. BTLE requires a source that can emit a Bluetooth signal and a recipient device that can receive these signals. Distribution of mobile scratchers via a Bluetooth beacon requires the use of low energy Bluetooth beacons (known as BTLE or BLE Beacons). These beacons constantly transmit an ID and major key. When detected, a user's mobile device can automatically make a request to download the mobile scratcher ticket associated with the detected beacon profile.

RFID or Radio Frequency Identification is a technology that uses the radio spectrum, e.g., 120 khz-13.56 MHz, or EAN RFID, e.g., 865-928 MHz (Covering European & North American standards) to broadcast a unique value that can be associated to specific scratcher ticket instances.

NFC or Near Field Communication is a technology that uses the 13.56 MHz radio frequency to broadcast a unique value that can be associated to specific scratcher ticket instances. The ideal use case for NFC is ultra close proximity (under a few inches).

RFID and NFC requires an encoding of RFID/NFC tags and a compatible RFID/NFC detection device. NFC and RFID can be used in a similar manner to deliver scratchers to the a user's mobile device. The triggering mechanism for these two methods is based on detection, validation, and response for unique values encoded into the radio frequency spectrum. These two triggering technologies tend to work in closer proximity than other triggering methods described herein.

High frequency audio tones are audio tones that exist above the range of human hearing (typically the 18-20 kHz spectrum). These tones can be generated in a specific finite pattern to allow the association of a unique value. High frequency audio requires a source, that is speaker capable of emitting audio within the 18-20 kHz spectrum and a device such as a microphone to detect the signals. In this manner, scratcher tickets can be distributed via high frequency sound. Leveraging a mobile application, mobile devices (phones, tablets, mp3 players/recorders, and any other device equipped with a display and a microphone that allows application installation) can listen for and decode a broadcasted high frequency (i.e., above normal human hearing ability) audio signal. High frequency audio sounds can be broadcasted via television, radio, mobile devices, tablets, computers, P.A. systems, or any other user controllable speaker equipped hardware.

AF or Audio Fingerprinting is a technology that scans the wave form of an audio file and extracts unique values based on the structure of the audio waveform peaks. These unique values can be then stored in a database to be associated with a specific scratcher ticket instance.

Wi-Fi or wireless network uses the 2.4 GHz and 5 GHz to generate signals for use by mobile devices.

Geofencing defines the ability to use GPS signals to provide a specific longitude/latitude as a trigger for application interactions. This can utilize a single point with a specified location radius or a specific polygon for a location. The specific longitude/latitude data can then be associated with a specific scratcher ticket instance. Geofencing requires the designation of a specific longitude/latitude as a threshold trigger and a compatible GPS/location detection device. Geofencing distribution involves the scratcher distributer defining a geographical location in proximity to a defined location (known as a geofence). When users cross a threshold and enter the geofenced area, an application running on the user's mobile device will notify a remote server. Upon location validation, a mobile scratcher is delivered to the user in the specific defined geofenced area.

As noted above, mobile scratcher tickets are distributed utilizing commonly used broadcast sources such as high frequency audio, BTLE, RFID, NFC, Wi-Fi, and geofencing as triggers to deliver interactable digital promotional scratcher style tickets to the end user. These triggers are associated with a unique numeric value that allows promotional scratcher tickets to be detected, validated and delivered via common broadcast methods that consumers interact with on a day to day basis.

Mobile scratcher tickets can also be delivered to a user's mobile device via a time based trigger. This involves creating a new or modifying an existing mobile scratcher ticket and assigning a time/date value for automated distribution to the user. Once the date/time threshold is reached, the associated mobile scratcher will then be automatically distributed to the user's mobile device. Timed triggers can also be used in tandem with other triggering methods. As one example, when a user enters a geofenced area, a scratcher ticket is then distributed to all users in the geofenced area at a predetermined date/time.

Mobile scratcher tickets can also be delivered to a user's mobile device via manual delivery. Manual mobile scratcher distribution allows content creators and providers to generate, upload and manually deliver scratcher tickets to all users or users who match a predetermined parameter set (demographic/interests/opt-in). This delivery method allows for the instantaneous delivery of the scratcher ticket to users at time of upload or any other future date/time based on a distributors desired user profile.

Mobile scratcher tickets are not limited to the above distribution methods. Almost any form of recognizable trackable digital interaction can be used to identify and deliver a predetermined mobile scratcher to a mobile device user.

Figure 1B:
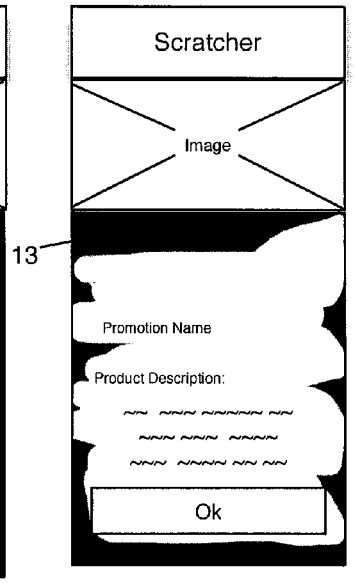
FIG. 1B shows a representation of a mobile device display with a scratcher while the opaque screen element is being removed.
Figure 1C:
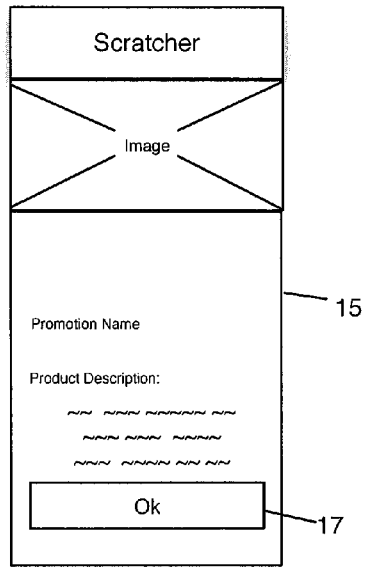
FIG. 1C shows a representation of a mobile device display with a scratcher after the opaque screen element has been removed.

Referring first to FIGS. 1A-1C, a user interacts with a received mobile scratcher ticket by tapping or swiping across the mobile device touch screen 11 in a predefined area. Once the user completes a defined percentage of the scratcher interaction, for example, uncovering at least 40% of the covered display area 13, the underlying scratcher ticket content 15 is displayed in the scratchable area. From this point, the user can chose to continue interaction via storing or redeeming the content, or ignoring the content if not interested. Although not shown in FIG. 1, after selecting the displayed OK button 17, the display would change to show available options which could be save for later use, redeem now or delete. The specifics of such possible options depend on the specifics of the scratcher content, neither of which are necessary for a proper understanding of the invention, and the implementation details of which would be readily apparent to persons having ordinary skill in the art based on the descriptions provided herein. The save for later use option could save the content on the mobile device so that the next time the application is launched on the mobile device, saved content can be accessed if desired. The content can also be saved on a server which can be the same server which provided the scratcher or another server. Again, the specific implementation details for these various options are well understood and are not needed for a proper understanding of the invention.

When a user receives a mobile scratcher ticket by virtue of a triggering event as described above, the user is identified via prior registration or unique device identifier to, if appropriate, ensure that all mobile scratcher tickets received are unique and are not duplicated on that device or any other registered device. For example, the mobile device could send a stored user name and password associated with an application on the mobile device to the server which will provide the scratcher to the mobile device once it is confirmed that the user and/or device are registered and have not previously received the scratcher. That is, since some scratcher offers are intended to be one-time events, it is necessary to ensure that the same offer is not sent to the same user and device a second time. The specifics of such verification are dependent on the specifics of the scratcher offer and the specific implementation details for these various options are well understood and are not needed for a proper understanding of the invention.

Interaction Flow

Figure 2:
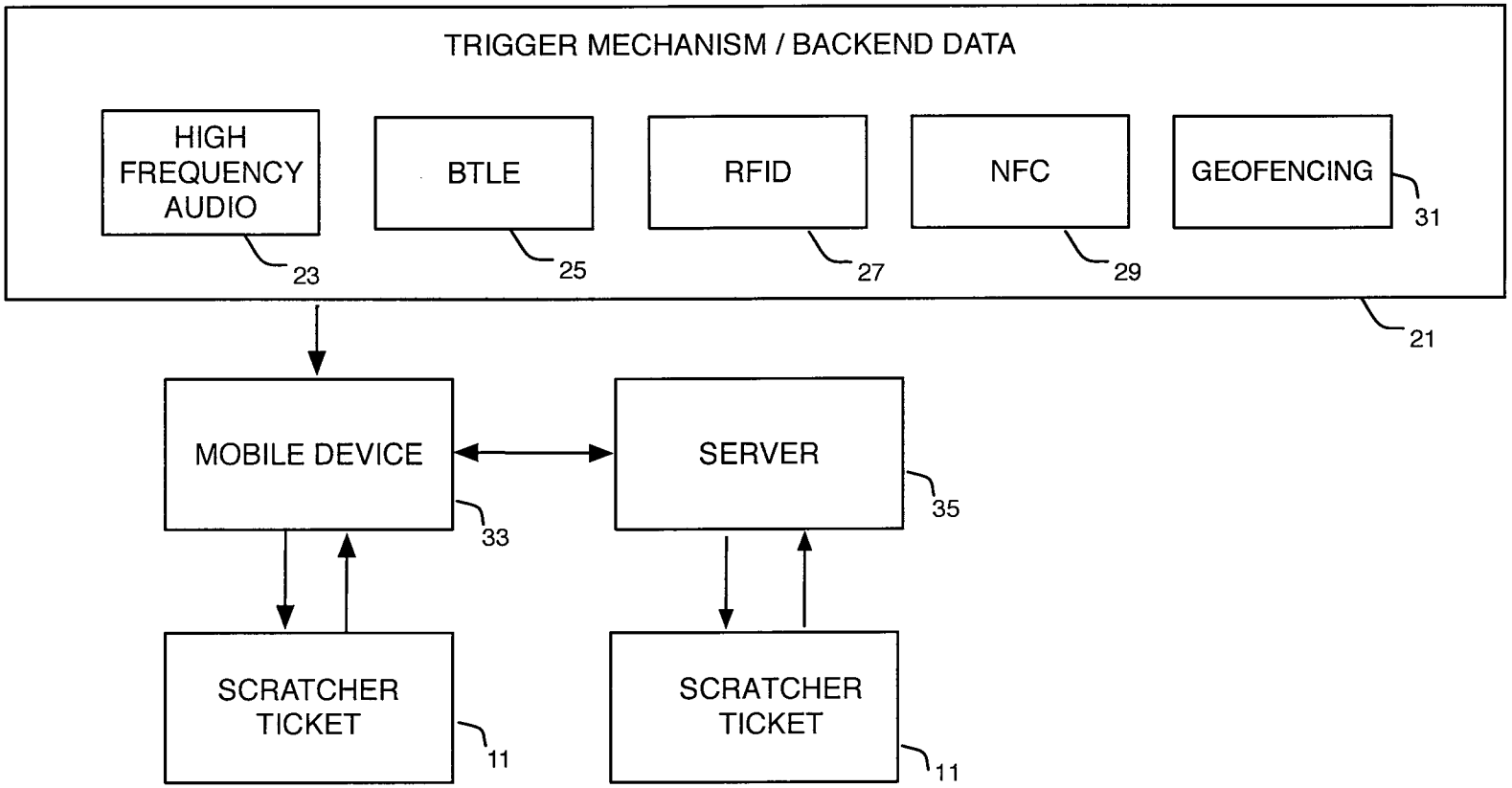
FIG. 2 is a block diagram showing the elements of the invented system.

FIG. 2 is a block diagram which shows the system elements and a flow that outlines the consumer interaction process. This flow cover the process from the trigger assignment though customer receipt and data aggregation.

A trigger mechanism is set up in a backend data environment 21, wherein a trigger is associated with a scratcher ticket 11. This trigger can be a 1:1 scratcher (meaning one trigger value is assigned to one constant scratcher) or it can equal 1: many (meaning that one trigger value can be associated with a dynamic array of scratcher variants). The applied triggers have differing interaction dependencies but provide a wide spectrum of delivery methods described herein as, for example, high frequency audio 23, BTLE 25, RFID 27, NFC 29 and geofencing 31.

Once a trigger has been assigned to a specified scratcher or dynamic array, a compatible device, such as a smart phone or other mobile device 33 then detects the broadcasted signal. Upon detection, device 33 validates the signal and checks for a recognizable string value. If a recognizable string is detected, the device calls server 35. Server 35 also validates the string, and if valid, the server retrieves the associated scratcher ticket. If this is a 1:1 assignment, that specific scratcher ticket 11 is then sent to device 33. If the scratcher exists in a dynamic array, then random distribution logic is applied and a scratcher is selected for sending to device 33. Further details regarding random distribution logic are specified below. Although trigger mechanism/backend data 21 and server 35 are shown as separate blocks in FIG. 2, as should be readily apparent to persons having ordinary skill in the art, the functions performed by blocks 21 and 35 can be physically consolidated on a single server or spread among any number of servers.

In an embodiment, there are other variables that can also influence the returned scratcher variant such as age, gender, and location if these rules are applied to the distribution model logic.

Device 33 receives the digital scratcher from server 35 and it is displayed on the display of the device. At the time of receipt, the underlying content has been determined. This does not decrease the level of randomness to the process, since the randomization is just applied pre-distribution. By using a pre-distribution randomness, the amount of calls to the server and backend data process is reduced which speeds up the consumer interaction process.

Upon user interaction (scratching the display of device 33 to reveal the underlying content), the interaction data, that is user response, is then sent to the backend data environment 21. Upon receipt of the interaction data, the data is stored in relation to the user's account which has been previously set up using well known techniques. This interaction data is used to ensure that the end user always receives a new and unique variant of scratcher.

If the user chooses to save any content associated with the scratcher, this data is then sent to the same backend environment 21 or server 35.

If the user chooses to decline or delete any associated content with the scratcher, then a call is made to the backend data environment 21 or server 35 to remove the associated content from the users profile.

Figure 3A:
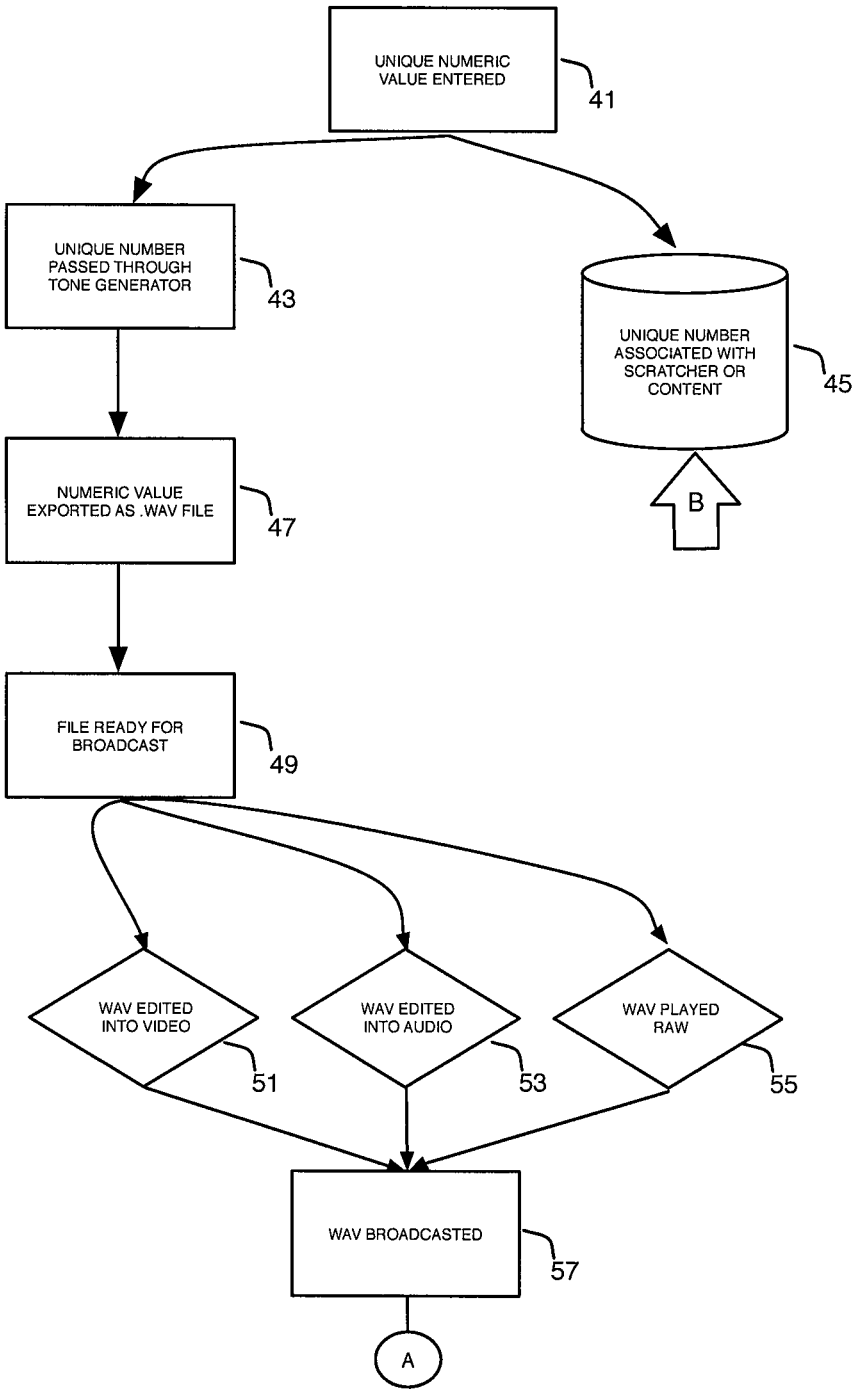
FIGS. 3A-3C are a flowchart showing the overall flow showing the creation of a digital scratcher ticket to storing the results after user interaction with the scratcher.
Figure 3B:
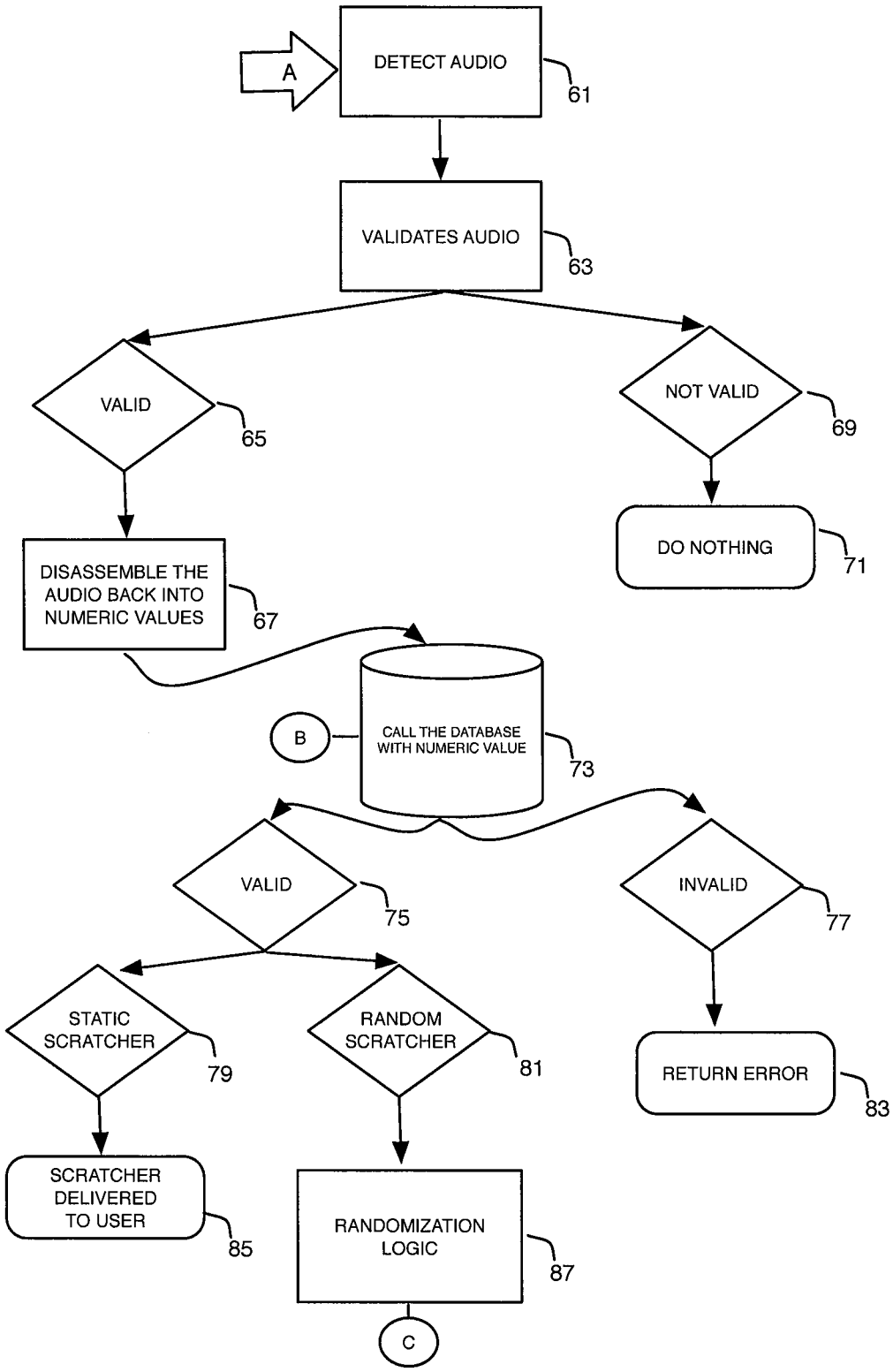
Figure 3C:
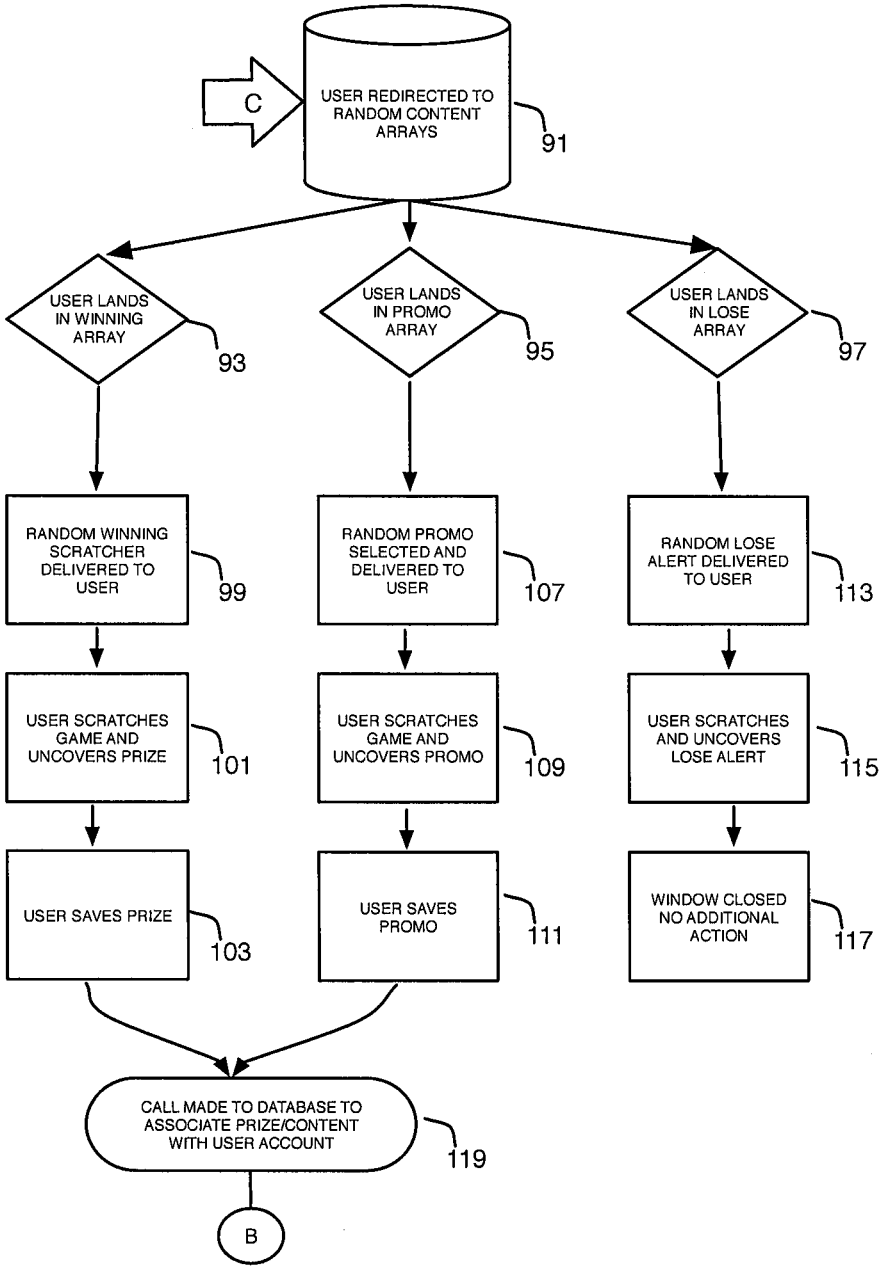

Referring to FIGS. 3A-3C, details regarding the trigger mechanism/back end data 21 will now be described.

Firstly, a unique numeric value is provided and entered 41 by the ticket scratcher provider. If the trigger mechanism to be utilized is BTLE 25, RFID 27, NFC 29, geofencing 31, or other trigger mechanism which does not require further processing before sending to the user device, the unique numeric value is associated with the scratcher 11 or other content in database 45.

Otherwise, the unique numbers pass through tone generator 43 and are exported as a .wav file 47, creating a file ready to be broadcasted 49. It may be edited into a video file 51, such as an .mp4 file, or it may be edited to an audio file 53, such as an .mp3 file, or it may be played RAW 55. The edited file or RAW file is then broadcasted 57 so that the file is played through a speaker (not shown).

Referring now to FIG. 3B, the audio file is then detected and validated as follows. A microphone (not shown) built into mobile device 33 detects the audio from the speaker. The detected audio file is then validated to make sure it has the proper structure. Such validation is performed by ensuring that the tone is the proper length, e.g., 9 digits, although any desired length for the trigger can be used.

If the audio cannot be validated 69, then no further action is taken 71.

Figure 4:
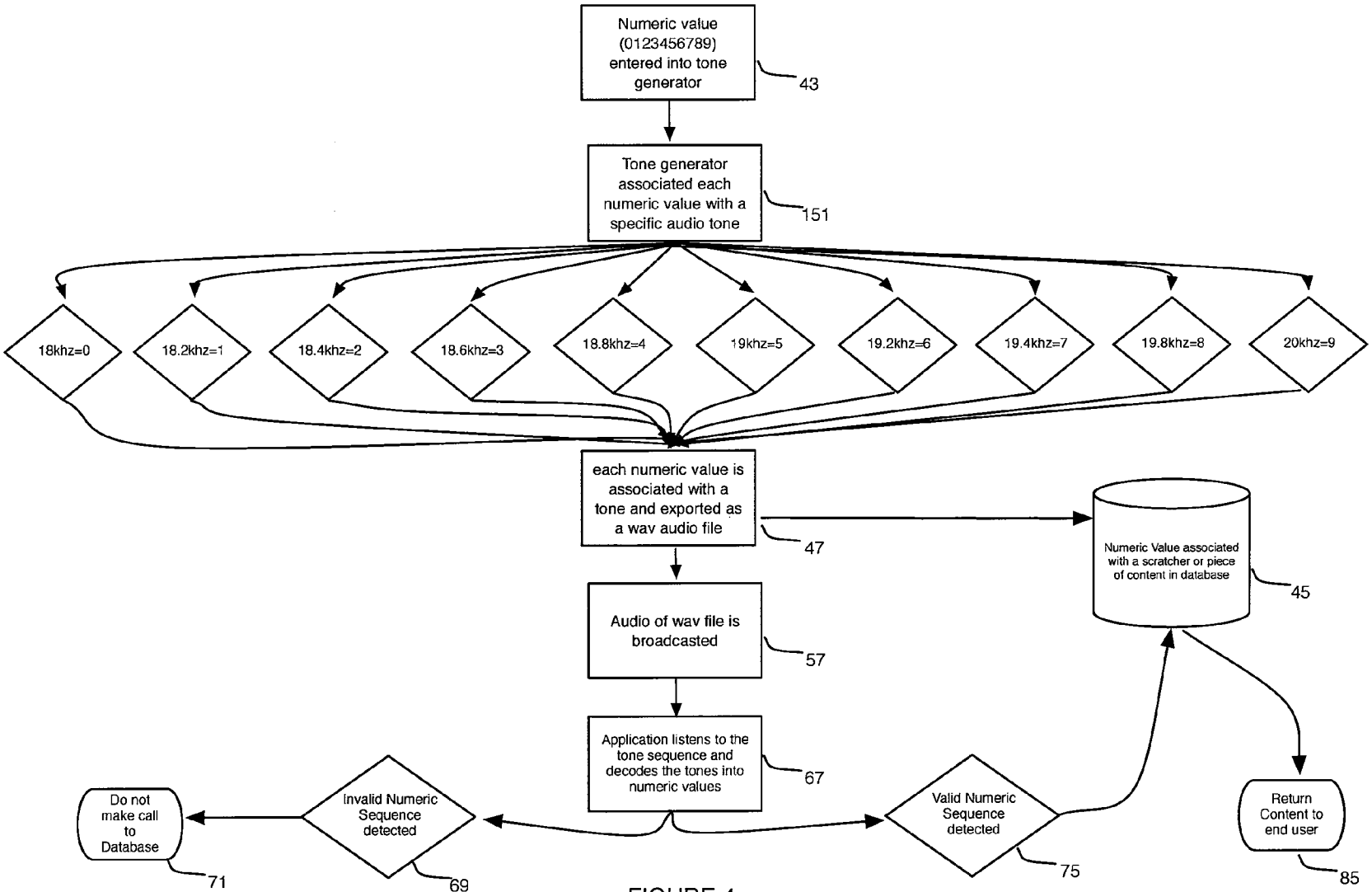
FIG. 4 is a flowchart showing the generation of high frequency audio tones can be used to represent a numeric value.

If the audio is valid 65, it is disassembled 67 back into the unique numeric value, as will be described with reference to FIG. 4. At this point, a database on server 35 is called 73 and the content, which corresponds to the unique numeric value contained in database 45, is obtained if the numeric value is valid. If valid 75, if the ticket is a static scratcher 79, it is delivered 85 to the user's mobile device 33. If it is not valid 77, an error 83 is returned.

If the scratcher is a random scratcher 81, then randomization logic 87 is used to determine if the scratcher is a winning ticket, is a promotional ticket, or is a losing ticket.

In this connection, referring to FIG. 3C, the resulting randomization logic 87 is provided to random content array 91, from which a scratcher is selected from a winning array 93, a promotional array 95, or a losing ticket array 97.

The randomly selected ticket is delivered to the user's mobile device 33. If a random winning ticket 99, the user scratches the display to uncover the prize 101 and then saves the prize 103. If the ticket is promotional ticket, it is delivered 107 to the user's mobile device 33. The user then scratches the display to uncover the promotion 109. The user then saves the promotion 111.

In the event of a losing ticket, the losing ticket is delivered 113 to the user's mobile device 33. The user scratches the display to uncover the lose alert 115. Then, the window closes with no further action taken 117.

In the event of a winning ticket or promotion, a call 119 is made to database 45 to associate the prize or promotion with the user's account.

Digital Scratcher Ticket Specifics

The mobile device includes a scratcher application which decodes the audio ID data embedded in the common broadcast source or the data contained in another trigger source of the type described herein. Once the data is decoded, the associated scratcher ticket is then displayed on the user's mobile or other device (ready for interaction). As one example, a scratcher containing an offer to obtain a 20% discount on a product purchased by using the scratcher, which includes an image of the product, and text describing the product and the offer would be sent using the following data structure:

Image-a-png or other format image file

Text-an ASCII or other text format file

Offer ID-an alphanumeric value in ASCII or other text format file

Security Code-an encrypted value

Using randomization logic, the content displayed in the digital scratcher ticket can be dynamically generated as each user device 33 receives the offer. This allows for randomness of the scratcher logic. Where some users may receive an offer that provides 20% discount of a product, others may receive a differing/greater/lesser valued mobile scratcher ticket. The randomization logic is based on the organization of random content arrays 91 which can have any desired distribution of winning, promotional and losing tickets.

Digital Scratcher Ticket Variations

Although the types of scratchers are unlimited, examples of mobile scratcher ticket types include:

Scratch to Reveal offer/prize: The end user scratches the screen to reveal if they received an offer of value or a prize.

Scratch and Match: The end user scratches the screen to determine if they have three or more matching numbers, values, or images. Uncovering three or more matching items identifies their device as a winner of the displayed prize/offer.

Word Hunt Scratch Games: A crossword puzzle is displayed on screen, and a list of predetermined letters. The user then scratches the predetermined letters away from the crossword puzzle (uncovering prizes along the way).

Lucky Scratch: The user has nine boxes but are only allowed to scratch three. The user must find three matching items or find one winning item hidden in the set of nine boxes.

The scratcher variants listed above are an example of the types of variation that can be delivered to the user. There are numerous applications/variations that can be used with the invented system. Any type of interactive content revolving around uncovering an underlying asset by manual rub or scratch based removal can be provided using the invented system.

Practical Uses

The digital scratchers are designed to be a consumer engagement product. The area of engagement can fall into a couple of common use case scenarios such as user entertainment, and targeted marketing.

In an entertainment scenario, the digital scratchers can be used in a gamified manner, in which users receive a predetermined quantity of scratchers and play the associated game to see what is uncovered.

In a marketing scenario, the digital scratchers can be associated with multiple differing demographic points and provide a targeted piece of underlying content to the user based on the user's demographics. An example of this is a user could enter a retail location, and based on the geo proximity to the specific retail location, a mobile digital scratcher could be delivered to the user. Upon scratching the screen, the underlying retail location specific promotional content is revealed.

In addition to the the above-described use cases, there are many other applicable uses for the mobile scratcher technology (e.g., sporting event, concerts, 1:1 communication, media interaction/engagement and others).

The product can work across numerous currently existing technologies to distribute the scratchers with no or minimal modification to the underlying technology.

The product can be designed to make decisions as to the scratcher to be provided based on the users demographic and other varying data points to deliver a random game each time.

The product can deliver a predetermined specific game instance to the user if chosen.

The product can leverage common technologies such as (BTLE Beacons, RFID, NFC, Wi-Fi, GeoLocation, GeoIP, Push Notification, XMPP Jabber, Audio Fingerprinting, AR (Augmented Reality), other interactable technologies to identify and deliver mobile digital scratchers to the end user.

The product can analyze, aggregate, and make decisions based on user trends and interactions.

The invention is implemented as a system and method using the various hardware elements described above with appropriate programming of the trigger mechanism, back-end data mechanism, mobile device and server to provide the described functionality. Each of these elements uses a processor, storage and programming to supplement the generic functionality of these devices to produce functionality not currently available. The specifics of the processors and storage elements utilized are well known to persons skilled in the art, and such details are not needed for a full understanding of the invention. Providing scratcher ticket functionality on a mobile or other device which operates in conjunction with triggering mechanisms based on broadcasted audio and radio frequency signals provides marketing and other advantages not currently available using prior art techniques.

Although the invention has been described using various examples and detailed descriptions, the invention is not intended to be limited by the specific examples and descriptions provided, but rather is limited only by the following claims.

I claim:

1. A system for displaying a digital scratcher ticket on a device having an interactive display comprising:

a) a backend data storage and processing unit configured to create and store data corresponding to a digital scratcher ticket having a unique identifier associated therewith;

b) a trigger mechanism storage and processing unit configured to generate a trigger signal for use by said device having said interactive display;

wherein upon receipt of said trigger signal by said device, said device operates to receive said stored data corresponding to a digital scratcher ticket created by said backend data storage and processing unit and validate said data with said backend data storage and processing unit, said validated data being used to display said digital scratcher ticket having said unique identifier associated therewith on said interactive display, wherein said displayed digital scratcher ticket is hidden until a user of said device interacts with said interactive display to reveal said digital scratcher ticket on said display, wherein said trigger signal is a high frequency audio signal encoded with a numeric value corresponding with said unique identifier, and said numeric value is encoded by associating a specific audio tone with a digit between 0 and 9, and a series of said specific audio tones represents said numeric value.

2. The system defined by claim 1 wherein a server communicates with said device, and said backend data storage and processing unit and is configured to process data received from said device and said backend data storage and processing unit to associate the digital scratcher ticket sent by said a backend data storage and processing unit to said device so that a result of a user using said interactive display to reveal said digital scratcher ticket is stored on said server.

3. The system defined by claim 1 wherein said high frequency audio signal is between 18 kHz and 20 kHz.

4. The system defined by claim 3 wherein said specific audio tone is associated with said digits between 0 and 9 as follow:

18.0 kHz=0,
18.2 kHz=1,
18.4 kHz=2,
18.6 kHz=3,
18.8 kHz=4,
19.0 kHz=5,
19.2 kHz=6,
19.4 kHz=7,
19.8 kHz=8,
20.0 kHz=9.

5. The system defined by claim 1 wherein said series of said specific audio tones corresponds to said unique identifier.

6. The system defined by claim 1 wherein said series of specific audio tones are sent to a speaker and a microphone associated with said device detects said specific audio tones and said device operates to decode said specific audio tones into said numeric value.

7. The system defined by claim 6 wherein said decoded numeric value is used by said device to communicate with a server and said backend data storage and processing unit which is configured to process said decoded numeric value sent by said device, and said backend data storage and processing unit operates to associate the digital scratcher ticket corresponding to said decoded numeric value, said associated digital scratcher ticket provided to said device for display on said interactive display wherein a user using said interactive display reveals said digital scratcher ticket, and a result of said revealed digital scratcher ticket is stored on said server.

8. The system defined by claim 1 wherein said validated data is used to determine if said digital scratcher is one of a static digital scratcher ticket and a random digital scratcher ticket.

9. The system defined by claim 8 wherein if said digital scratcher is a static digital scratcher ticket, said static digital scratcher ticket is displayed on said interactive screen display after user of said device interacts with said interactive display to reveal said static digital scratcher ticket on said display.

10. The system defined by claim 8 wherein if said digital scratcher ticket is a random digital scratcher ticket, a random content array is used to select a digital scratcher ticket to be displayed which is selected among a set of digital scratcher ticket types including a winning ticket, a promotional ticket and a losing ticket, wherein said selected digital scratcher ticket is displayed on said interactive screen display after a user of said device interacts with said interactive display to reveal said selected digital scratcher ticket on said display.

11. A method for displaying a digital scratcher ticket on a device having a interactive display comprising:

a) creating and storing data corresponding to a digital scratcher ticket having a unique identifier associated therewith;

b) generating a trigger signal for use by said device having said interactive display;

c) upon receipt of said trigger signal by said device, receiving said stored data corresponding to a digital scratcher ticket created by said backend data storage and processing unit and validating said data with said backend data storage and processing unit;

d) preparing said digital scratcher ticket having said unique identifier associated therewith for display on said interactive display;

e) hiding said displayed digital scratcher ticket until a user of said device interacts with said interactive display to reveal said digital scratcher ticket on said display, wherein said trigger signal is a high frequency audio signal encoded with a numeric value corresponding with said unique identifier, and said numeric value is encoded by associating a specific audio tone with a digit between 0 and 9, and a series of said specific audio tones represents said numeric value.

12. The method defined by claim 11 further comprising processing said data to associate the digital scratcher ticket with said device so that a result of a user using said interactive display to reveal said digital scratcher ticket is stored on a server.

13. The method defined by claim 11 further comprising using said validated data to determine if said digital scratcher is one of a static digital scratcher ticket and a random digital scratcher ticket.

14. The method defined by claim 13 wherein if said digital scratcher is a static digital scratcher ticket, displaying said static digital scratcher ticket on said interactive screen display after said user of said device interacts with said interactive display to reveal said static digital scratcher ticket on said display.

15. The method defined by claim 13 wherein if said digital scratcher ticket is a random digital scratcher ticket, randomly selecting a digital scratcher ticket to be displayed among a set of digital scratcher ticket types including a winning ticket, a promotional ticket and a losing ticket, and displaying said selected digital scratcher ticket on said interactive screen display after said user of said device interacts with said interactive display to reveal said selected digital scratcher ticket on said display.

* * * * *